US006646529B1

(12) United States Patent
Kahnert et al.

(10) Patent No.: US 6,646,529 B1
(45) Date of Patent: Nov. 11, 2003

(54) ELECTROMAGNETIC RELEASE

(75) Inventors: Andreas Kahnert, Ober-Ramstadt (DE); Heinz-Erich Popa, Bammental (DE); Hans-Joachim Krokoszinski, Nussloch (DE); Patrick Claeys, Darmstadt (DE)

(73) Assignee: ABB Patent GmbH, Ladenburg (DE)

( * ) Notice: Subject to any disclaimer, the term of this patent is extended or adjusted under 35 U.S.C. 154(b) by 256 days.

(21) Appl. No.: 09/603,751

(22) Filed: Jun. 26, 2000

(30) Foreign Application Priority Data

Jun. 24, 1999 (DE) ..... 199 29 160

(51) Int. Cl.[7] ..... H01F 7/08
(52) U.S. Cl. ..... 335/229; 335/234
(58) Field of Search ..... 335/6, 21, 38, 335/167–184, 229–234

(56) References Cited

U.S. PATENT DOCUMENTS

| | | | | | |
|---|---|---|---|---|---|
| 3,683,239 | A | * | 8/1972 | Sturman | 335/170 |
| 3,755,766 | A | * | 8/1973 | Read, Jr. | 335/229 |
| 4,127,835 | A | * | 11/1978 | Knutson | 310/30 |
| 4,134,090 | A | * | 1/1979 | Schuessler et al. | 335/229 |
| 5,661,446 | A | * | 8/1997 | Anderson et al. | 310/13 |
| 6,076,550 | A | * | 6/2000 | Hiraishi et al. | 137/550 |

* cited by examiner

*Primary Examiner*—Ramon M. Barrera
(74) *Attorney, Agent, or Firm*—Laurence A. Greenberg; Werner H. Stemer; Ralph E. Locher

(57) ABSTRACT

An electromagnetic release drive, particularly suitable for a residual current circuit breaker, includes a plunger loaded by a spring in a release direction, a permanent magnet configuration, a coil and a yoke. The coil generates in the yoke a magnetic flux opposed to the permanent magnet configuration when the coil is driven or released such that the spring force overcomes the attraction force of the permanent magnet configuration. The permanent magnet configuration and the pole shoe conducting the magnetic flux to the plunger are associated with the yoke and the plunger such that, in a first position, the plunger is located in the active range of the permanent magnet configuration and of the pole shoe and, in a second position, is located at least partly in the active range of the pole shoe. Thus, in a first position, both the magnetic flux of the coil and that of the permanent magnet configuration, the latter at least partly, run through the plunger and, in the second position of the plunger, a closed magnetic circuit is formed by the yoke, the plunger, the pole shoe, and the permanent magnet configuration. The invention achieves two advantages. First, the working point of the permanent magnet configuration is maintained even in the release position, i.e., the second position. Second, the permanent magnet configuration can be magnetized with the coil.

11 Claims, 4 Drawing Sheets

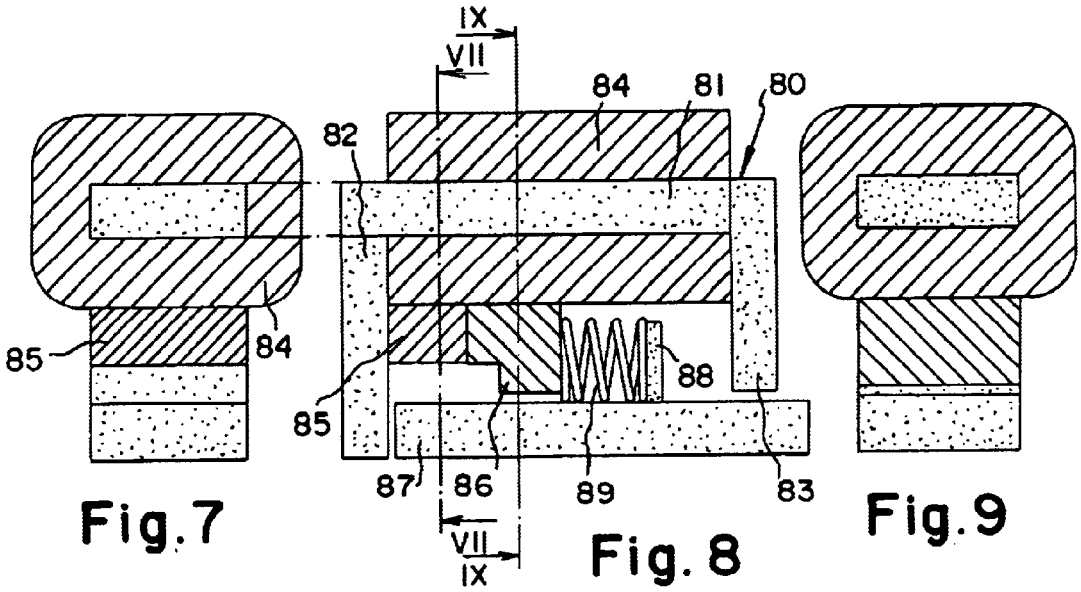
Fig.7
Fig. 8
Fig.9
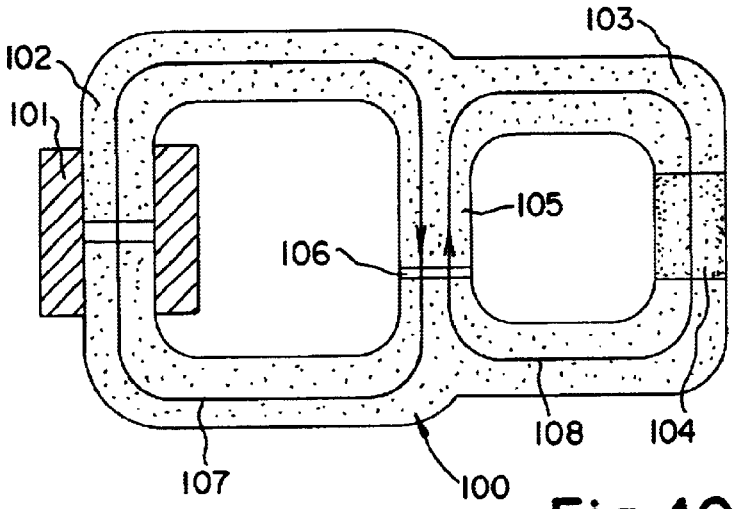
Fig.10
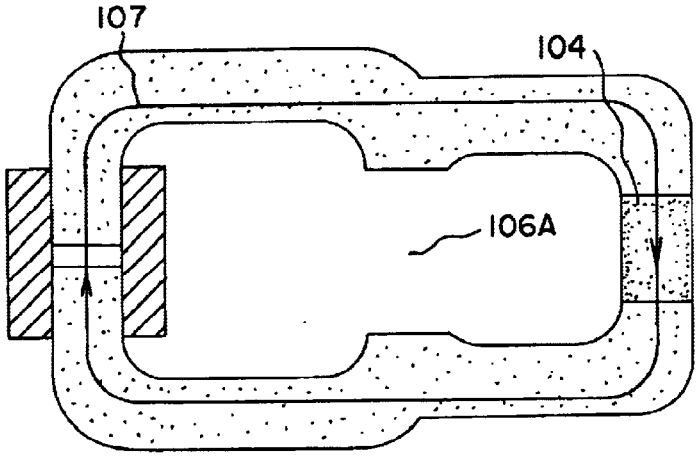
Fig.11

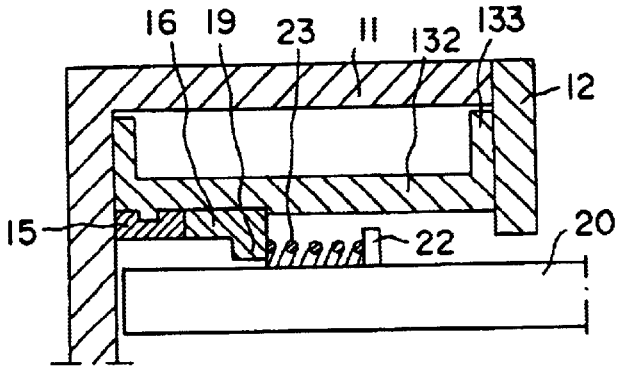
Fig.14
Fig.12
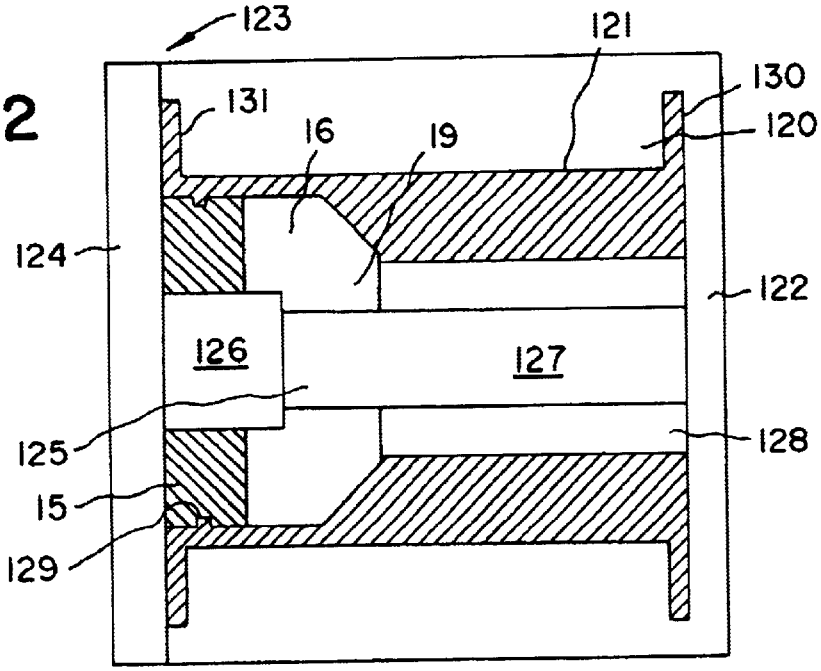
Fig.13
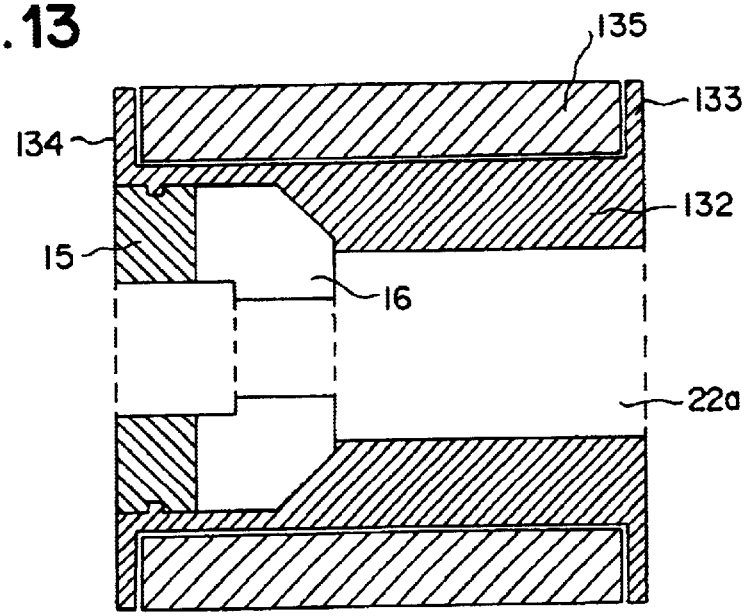

ELECTROMAGNETIC RELEASE

BACKGROUND OF THE INVENTION

Field of the Invention

The invention relates to an electromagnetic release for a protective circuit breaker, in particular, for a residual current circuit breaker.

Conventionally, a release used for a network- or mains-voltage-independent residual current protective device was based upon a magnetic circuit on the compensation principle. A U-shaped magnetic yoke is provided. A coil is wound around one limb of the yoke. On the yoke there is a permanent magnet, and the two limbs of the yoke are covered by an armature, which is spring loaded into the disconnect or release position. The permanent magnetic acts such that the armature, in the quiescent state, is attracted against the free ends of the limbs of the yoke. If a fault current occurs, then the magnetic flux generated by the fault current acts against the flux generated by the permanent magnet, so that the spring overcomes the attraction force and pivots the hinged armature into the opening position.

In addition to such holding-magnet releases, blocking magnet releases have also been used, but these are used much less frequently. The coil winding is connected to a secondary winding of a summation current transformer, whose primary winding is formed by the live conductor. As soon as a fault current occurs, current is applied to the coil of the release in a conventional manner, and the release responds.

In the event of an adhesion layer being present between the armature bearing face and the surface of the pole, the excess force from the spring, which moves the armature in the disconnect direction, is sometimes inadequate to break the contact between the armature and the pole face, and, in this example, the release fails.

It is necessary for the pole surface to be polished in order to achieve an adequate magnetic adhesion force. The pole face and the air gap present are extremely critical variables. Therefore, for example, applying a protective layer as a measure against sticking cannot be used. Furthermore, the geometry of the configuration makes automated production increasingly difficult because the individual parts have to be produced with high precision and monitoring, and have to be assembled with a great deal of personal, i.e., manual, effort, under clean-room conditions.

Because sticking sometimes cannot be avoided, the user is recommended in general terms to operate a test push-button once a month in order to check the serviceability of the release. When the test push-button is actuated, a fault current is simulated, so that the release responds and the residual current circuit breaker opens.

Because regular testing of a residual current circuit breaker is often not performed, in particular, in a domestic household, consideration has been given to avoiding possible sticking of the hinged armature in the event of a fault current. To such an end, carrying out automatic testing with automatic opening has been proposed. Such automatic testing can be disadvantageous to the extent that current interruptions are produced as a result of the automatic opening of the circuit breaker. Such interruptions are mostly undesired and present problems, which will not be further discussed.

In addition, there are also additional devices associated with the release in the form of additional releases. The additional releases are configured, for example, as piezoelectric elements or as electromagnetic releases. However, such additional elements and additional releases increase the outlay on the production of a residual current circuit breaker.

SUMMARY OF THE INVENTION

It is accordingly an object of the invention to provide an electromagnetic release that overcomes the hereinafore-mentioned disadvantages of the heretofore-known devices of this general type and that prevents sticking to the greatest possible extent, so that a release can be used readily even in a residual current circuit breaker for unlatching a switching mechanism. In particular, the electromagnetic release of the invention has fewer parts and has a simpler configuration. Accordingly, automatic production is improved and manufacture time and cost are reduced.

With the foregoing and other objects in view, there is provided, in accordance with the invention, an electromagnetic release, including a yoke, a spring disposed in the yoke and having a spring force, a plunger loaded by the spring in a release direction, a permanent magnet configuration associated with the yoke and the plunger and having a magnet flux, an attraction force, and an active range, a coil associated with the yoke and generating in the yoke a magnetic coil flux opposed to the magnet flux such that, when the magnetic coil flux is released, the spring force overcomes the attraction force of the permanent magnet configuration, and at least one pole shoe assigned to the yoke and the plunger and having an active range, the at least one pole shoe and the permanent magnet configuration conducting the magnetic coil flux to the plunger such that, in a first position of the plunger, the plunger is located in the active range of the permanent magnet configuration and in the active range of the at least one pole shoe, and both the magnetic coil flux and at least part of the magnet flux run through the plunger, and, in a second position of the plunger, the plunger is located at least partly in the active range of the at least one pole shoe, and the magnet flux runs through the yoke, the plunger, and the permanent magnet configuration.

According to the invention, at least one permanent magnet and at least one pole shoe are assigned to the yoke and to the release plunger such that, in a first position, the plunger is located in the active range of the permanent magnet and of the pole shoe and, in a further position, is located only in the active range of the pole shoe. Accordingly, in the first position, both the magnetic flux from the coil and that from the permanent magnet, the latter at least partly, run through the plunger. In the second position, the magnetic field generated by the permanent magnetic runs through the plunger, the permanent magnet and the yoke, so that in the latter position a stable working point of the permanent magnet is maintained.

In accordance with another feature of the invention, the yoke has two yoke sections running parallel to each other, to which the plunger axis runs perpendicularly. The plunger reaches through one of the yoke sections (first yoke section), forming an air gap, whose width remains constant during the entire movement of the plunger. Thus, a change in the force on the plunger is avoided.

In accordance with a further feature of the invention, in its first position, the plunger bears against the inner face of the second yoke section. Due to the configuration of the release, the release force being sufficiently high, processes involving sticking of the plunger to the second yoke section, which could give rise to an ineffective release, are avoided.

In accordance with an added feature of the invention, to provide assistance, the plunger can be coated with an anti-adhesion layer on its actuating face facing the second yoke section. The layer may be made of a material that is as corrosion resistant as possible, in particular of nickel or a nickel alloy.

In accordance with an additional feature of the invention, the plunger can preferably have a ridge; the spring is then inserted between the pole shoe and the ridge.

In accordance with yet another feature of the invention, the yoke is a closed ring and has limbs disposed opposite the first of the two yoke sections, the coil is disposed inside the yoke, and the plunger, the permanent magnet configuration, and the at least one pole shoe are disposed inside the coil, the permanent magnet configuration bears against the inner face of the second of the two yoke sections, the at least one pole shoe is disposed coaxially with the permanent magnet configuration, the permanent magnet configuration and the at least one pole shoe accommodate the plunger therebetween in a quiescent state of the coil, and the plunger reaches through the limbs.

In accordance with yet a further feature of the invention, the yoke has at least a U-shape, at least one web, and at least one limb, the coil surrounds the at least one web, and the at least one limb forms the first of the two yoke sections and covers the end face of the plunger.

In accordance with yet an added feature of the invention, the U-shaped yoke has an integral further yoke piece, the at least one limb is two limbs forming two parallel yoke webs, the permanent magnet configuration and the plunger bear against one of the two yoke webs, and the plunger reaches through another of the two yoke webs.

According to a particularly advantageous refinement of the invention, the yoke can have a pot, into which the annular coil, the permanent magnet configuration constructed as an annular permanent magnet, the annular pole shoe, the spring constructed as a helical spring and the plunger can be inserted in the following way. The plunger is surrounded both by the permanent magnet and by the pole shoe and the spring. The pot is closed by a cover, through which the plunger reaches. In order to form the release, the cover serves as the first yoke section and the bottom of the pot forms the second yoke section.

In accordance with yet an additional feature of the invention, there is provided a sleeve of insulating material, the bottom of the pot has an inner side, and the at least one pole shoe and the permanent magnet are pressed against the inner side of the bottom of the pot with the sleeve of insulating material.

Another configuration considerably simplifies the manufacture of the release. It is possible to prefabricate the configuration of the permanent magnet configuration, pole shoe, coil former and coil and simply insert it into the pot. In accordance with still another feature of the invention, the at least one pole shoe and the permanent magnet are cast into a cylindrical body to form a coil former, such that the coil, the coil former, the at least one pole shoe, and the permanent magnet form a pre-assembled unit.

In accordance with yet an additional feature of the invention, the permanent magnet has at least one of the group consisting of a circumferential ridge and a groove holding the permanent magnet on the coil former in a form-fit.

In accordance with again another feature of the invention, the plunger is moveable away from the one of the two yoke webs at most to place the end face of the plunger essentially in an area of the at least one pole shoe to ensure a flux through the at least one pole shoe, the plunger, and the yoke. This configuration provides a further advantage. If, the end of the plunger is located in the area of the pole shoe when the release, serving as a residual current release, has reached its release position, then the working point of the permanent magnet remains approximately constant in any possible position, because, in any possible position, a magnetic flux through the permanent magnet, the pole shoe, the plunger and the yoke is ensured.

In accordance with again a further feature of the invention, the permanent magnet configuration has an axial length, and a distance the end face of the plunger assumes from the one of the yoke webs when driven is greater than an axial length of the permanent magnet configuration.

In accordance with again an added feature of the invention, a released position is defined by the plunger being essentially located only in an area of the at least one pole shoe, and in the released position the permanent magnet configuration is magnetized by a current pulse through the coil. An advantage of this feature is provided by the released position of the coil, wherein a flux through the permanent magnet is generated, so that the permanent magnet can be magnetized by a pulse originating from the coil. As a result, it is no longer necessary to install the permanent magnet in the premagnetized state or to magnetize it from the outside in special, complicated devices. Instead, the permanent magnet is magnetized only when it has been mounted in the release.

In accordance with a concomitant feature of the invention, there is also provided a residual current circuit breaker electromagnetic release.

Other features that are considered as characteristic for the invention are set forth in the appended claims.

Although the invention is illustrated and described herein as embodied in an electromagnetic release, it is, nevertheless, not intended to be limited to the details shown since various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 8 is a diagrammatic, cross-sectional side view of another embodiment of the release of FIG. 5;

FIG. 7 is a diagrammatic, cross-sectional plan view of the release of FIG. 8 along the line VII—VII;

FIG. 9 is a diagrammatic, cross-sectional plan view of the release of FIG. 8 along the line IX—IX;

FIGS. 10 and 11 are schematic, cross-sectional side views of another embodiment and explain the action of the electromagnetic releases according to FIGS. 1 to 9;

FIG. 12 is a diagrammatic, cross-sectional side view of a mold for manufacturing the coil former;

FIG. 13 is a diagrammatic, cross-sectional side view of the release before insertion into the yoke; and FIG. 14 is a diagrammatic, partial, cross-sectional side view of the release.

DESCRIPTION OF THE PREFERRED EMBODIMENTS

Figure 1:
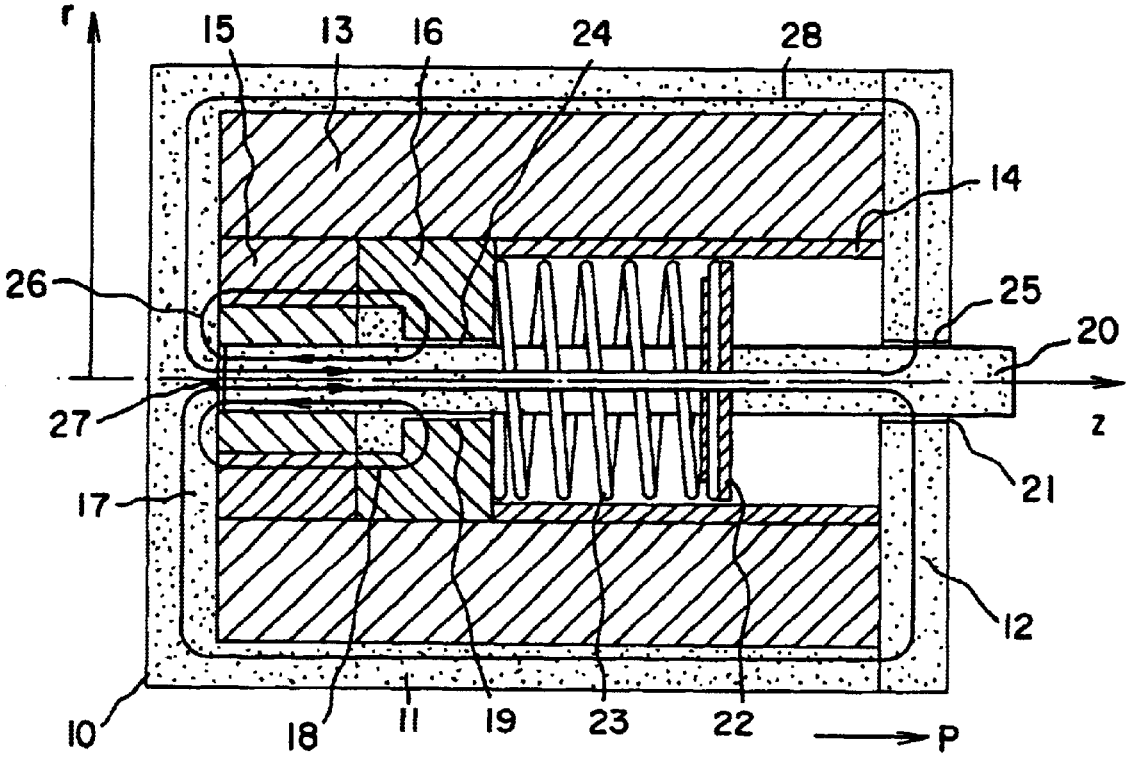
FIG. 1 is a diagrammatic, cross-sectional side view of an electromagnetic release according to the invention in a first, attracted position.

In all the figures of the drawing, sub-features and integral parts that correspond to one another bear the same reference symbol in each case.

Referring now to the figures of the drawings in detail and first, particularly to FIG. 1 thereof, there is shown an electromagnetic release having a yoke 10 with a bowl-like pot 11 that is closed by a cover 12. In the interior of the pot 11, adjoining the inner wall, there is an annular coil 13 that surrounds a plastic sleeve 14, a permanent magnet 15, and a pole shoe 16. The permanent magnet 15 is also annular, and it is seated directly on the bottom 17 of the pot 11. The permanent magnet 15 is adjoined by and touches the pole shoe 16. The pole shoe has two sections 18 and 19 of different internal diameter. The sleeve 14 holds the permanent magnet 15 and the pole shoe 16 in place against the bottom 17. The permanent magnet 15 and the annular pole shoe 16 surround a plunger 20 that bears against the inner face of the bottom 17 of the pot with one end face and, with its other end, projects out of the cover 12 from an opening 21. The plunger 20 has a circumferential annular ridge 22. Between the annular ridge 22 and the pole shoe 16 there is a helical compression spring 23. The internal diameter of the section 19 of the pole shoe 16 results in the formation of an air gap 24 between the inner face of the section 19 and the outer face of the plunger.

Correspondingly, there is a further air gap 25 between the inner face of the opening 21 and the outer face of the plunger 20. The internal diameter of the permanent magnet 15 then corresponds to the internal diameter of the section 18 of the pole shoe 16.

The permanent magnet 15 produces a magnetic flux. Depending on the alignment of the north and south poles, the main part 26 of the magnetic flux runs from the permanent magnet 15 into the pole shoe 16, through the air gap 24 into the plunger 20, from there into the yoke 10 and the bottom 17 of the yoke, and back to the permanent magnet 15. Between the plunger 20 and the bottom of the yoke 10 there is a very small working air gap 27. Due to the magnetic flux 26 of the permanent magnet 15, the plunger 20 is attracted towards the bottom 17 of the pot 11.

If a current flows through the coil 13, a magnetic flux 28 is generated. The magnetic flux 28 runs from the bottom 17 of the pot into the plunger 20, through the plunger 20 into the cover 12, and back again to the bottom 17 of the pot through the side wall 29 of the bottom of the pot. In other words, given appropriate polarization, the magnetic flux 28 acts counter to the permanent magnet flux 26 in the plunger 20. As a result, the flux 26 generated by the permanent magnet 15 is cancelled, and the spring 23 (under compression) moves the plunger in the direction of the arrow P until the ridge 22 comes to bear against the inner face of the cover 12. See plunger position in FIGS. 2 and 3. Therefore, the end of the plunger 20, which initially bears on the bottom 17 of the pot, has been moved away from the bottom of the pot and is located approximately still in the area of the permanent magnet 15. The working air gap 27 is then sufficiently great so that the permanent magnet 15 does not move the plunger back again towards the bottom of the pot.

Figure 3:
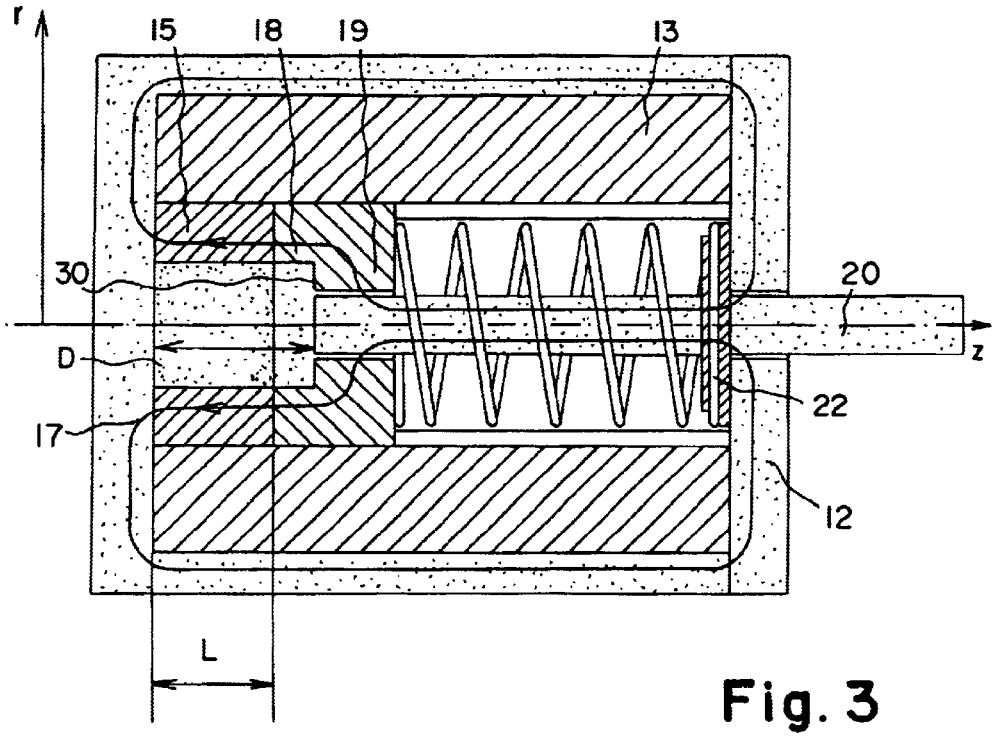
FIG. 3 is a diagrammatic, cross-sectional side view of another embodiment of the release of FIG. 1 in the second extended position.

It is also possible to dimension the plunger 20 or its travel such that the inner end of the plunger ends at the step 30 at which the section 18 merges into the section 19, see FIG. 3.

Figure 4:
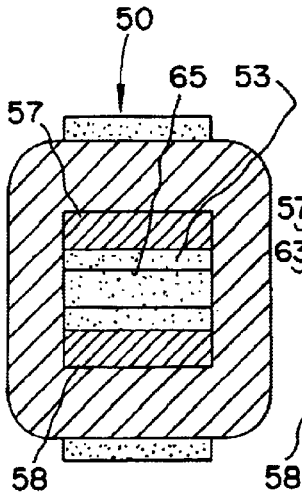
FIG. 4 is a diagrammatic, cross-sectional plan view of the release of FIG. 5 along the line IV—IV.
Figure 5:
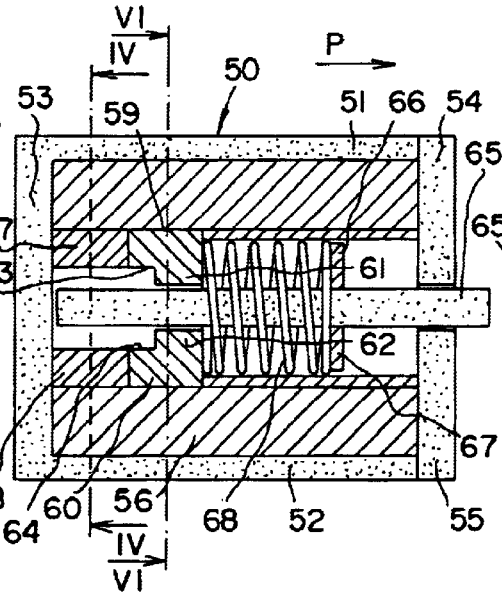
FIG. 5 is a diagrammatic, cross-sectional side view of a further embodiment of the release of FIG. 1.

FIG. 5 shows an annular, rectangular yoke 50 having two longitudinal webs 51 and 52 running parallel to each other and connected to each other at one respective end by a transverse web 53. Disposed at the other end of the longitudinal web 51 is a limb 54, and disposed at the other end of the longitudinal web 52 is a limb 55. The limbs 54, 55 run towards each other perpendicular to the longitudinal webs 51, 52 and end at a specific distance from each other. A coil 56 is inside the longitudinal webs 51 and 52. The coil 56 has a coil axis running parallel to the longitudinal webs 51 and 52. Inside the coil 56, in each case adjacent to the latter and bearing against the inner face of the transverse web 53, are two permanent magnets 57 and 58, each having a rectangular cross section whose width corresponds to the width of the transverse web 53. See FIG. 4.

The permanent magnets 57, 58 are adjoined respectively by pole shoes 59, 60 that respectively have two sections 61, 62 and 63, 64 similar to pole shoe 16. Sections 61, 62 are further remote from the transverse web 53 of the yoke 50 and from the permanent magnets 57, 58. The thickness of the sections 63, 64, as measured in the direction of the transverse web 53, is smaller than the thickness of the sections 61, 62 and corresponds to the thickness of the permanent magnets 57, 58. See FIG. 5.

Between the permanent magnets 57, 58 and the pole shoes 59, 60 is a rectangular plunger 65 having a width corresponding to the width of the yoke 50. The rectangular shape of the plunger is such that, between the sections 61 and 62, an air gap is formed that, with regard to its dimensions, corresponds approximately to the air gap 27. The plunger 65 projects beyond the limbs 54 and 55. The ends of the limbs 54, 55 respectively form with the plunger 65 an air gap that similarly corresponds to the air gap 25. The plunger 65 has extensions 66, 67 projecting in the direction of the transverse web 53. Between the pole shoes 59 and 60 and the extensions 66, 67 there is a compression spring 68 that loads the plunger permanently in the direction of the arrow P, in other words, out of the yoke 50.

Figure 2:
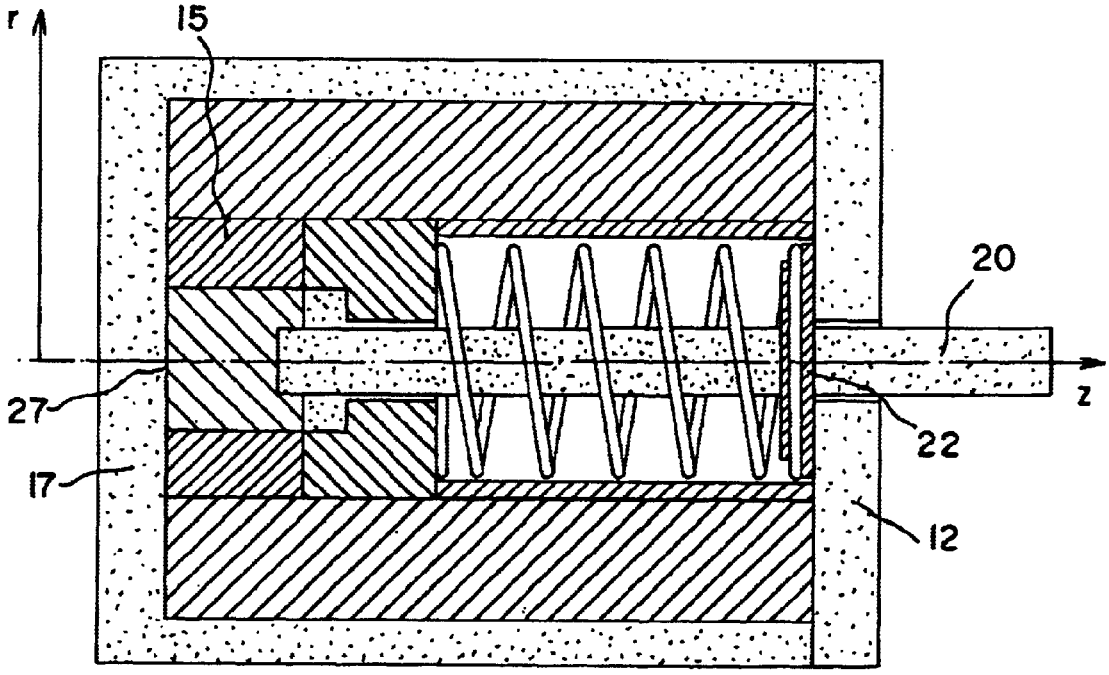
FIG. 2 is a diagrammatic, cross-sectional side view of the release according to FIG. 1 in a second extended position.
Figure 6:
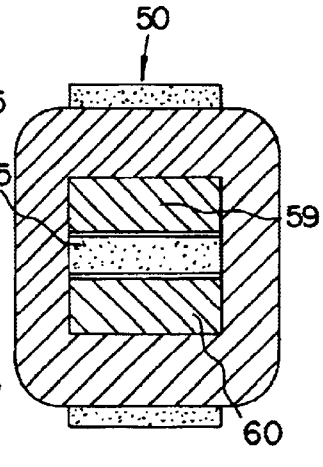
FIG. 6 is a diagrammatic, cross-sectional plan view of the release of FIG. 5 along the line VI—VI.

The action of the embodiments of FIGS. 4 to 6 is the same as in FIGS. 1 to 3. The permanent magnets 57 and 58 generate a non-illustrated magnetic flux through the pole shoes 59, 60 and the plunger 65 as far as the transverse web 53. When the coil 56 is energized then—depending on the direction of the current—a flux is produced through the plunger 65, running counter to the flux generated by the permanent magnets 57, 58. The energized flux reduces the attraction force on the plunger generated by the permanent magnets. Accordingly, the force of the compression spring is overcome and the plunger 65 is forced out of the yoke in the direction of the arrow P until the projections 66 and 67 come to bear against the inner faces of the limbs 54 and 55.

In the embodiment according to FIGS. 7 to 9, instead of a virtually closed yoke, the yoke 80 has a longitudinal web 81 with a limb 82, 83 at each of its ends. A coil 84 surrounds the longitudinal web 81. The coil 84 is adjoined by a permanent magnet 85 and the permanent magnet 85 is adjoined by a pole shoe 86 that, in terms of its shape, corresponds to the pole shoe 59. Also provided is an armature 87 or plunger 87 (corresponding to the armature 65) having one end covered by the limb 82 and another end projecting beyond the limb 83. A projection 88 is provided on the plunger 87. The projection 88 is oriented towards the coil 84. Between the pole shoe 86 and the projection 88 is a compression spring 89 that has the same action as the compression spring 23, 68. In the FIGS. 7 to 9 embodiment, many types of spring are possible, for example a spiral spring.

The action of the embodiment according to FIGS. 7 to 9 is the same as that of FIGS. 4 to 6. A difference being that the yoke is U-shaped and not closed.

FIGS. 10 and 11 show the action in a schematic illustration. A yoke 100 has a first yoke web 101 surrounded by a coil 102. The yoke 100 has a figure-eight shape and a further transverse web 103, in which is disposed a permanent magnet 104. The central web 105 of the figure-eight shape has a working air gap 106. The state illustrated in the embodiment of FIG. 10 shows the magnetic flux 107 originating from the coil 102 canceling the flux 108 originating from the permanent magnet 104 in the area of the working air gap 106 so that the plunger located in the area of the central web 105 can be moved by a suitable spring. The fundamental basic structure illustrated by FIG. 10 is implemented in a solution in the embodiments of FIGS. 1 to 9, with the preferred embodiment being the configuration according to FIG. 3.

The assembly of the electromagnetic release is very simple: the pot is manufactured, the coil is put into the pot, and the permanent magnet and the pole shoe as well as the sleeve are put into the coil in sequence, so that the permanent magnet is located between the bottom of the pot and the pole shoe. The plunger is then inserted, runs through the pole shoe, and, in the quiescent state, is attracted towards the bottom of the pot.

In the embodiment of FIG. 3, the magnetic flux 28 originating from the coil 13 flows through the plunger 20, the pole shoe 19, the permanent magnet 15 into the bottom 17 of the pot, through the side walls of the pot 11 to the cover 12, and, from there, into the plunger 20. Thus, virtually the entire magnetic flux 28 generated by the coil runs completely through the permanent magnet 15. With respect to the distance D and to the length L, the magnetic flux between the plunger 20 and the bottom 17 of the pot can be made to be opposed by a high magnetic resistance. Essentially, D should always be greater than L. As a result, the permanent magnet 15 can be magnetized to its working point by the magnetic flux 18 originating from the coil 13 and, because the magnetic flux originating from the permanent magnet 15 always runs through the coil 13, the working point of the permanent magnet is changed only insignificantly. In other words, it remains essentially stable. Based upon the configuration of FIG. 3, which also applies to FIG. 2, the action of the permanent magnet 15 is also maintained. FIG. 11 shows the schematic configuration: the magnetic flux 107 that originates from the coil runs completely or virtually completely through the permanent magnet 104 because of the high magnetic resistance in the working air gap 106A. Thus, the permanent magnet 104 can be magnetized by the flux 107 (or 28), and the working point of the permanent magnet 104 also remains stable.

The release illustrated is used, in particular, as a release in a residual current circuit breaker. A particular advantage is achieved, that is, the prevention of sticking by the end face of the plunger 20 to the bottom 17 of the pot. Therefore, the magnitude of the working air gap—in contrast to conventional holding-magnets or blocking-magnet releases, in which the corresponding parts in contact with each other have to be produced extremely precisely and accurately—is not so critical. Instead, the free end face of the plunger, which comes to bear against the bottom 17 of the pot, can also be coated with an anti-adhesion layer. Such a layer reliably avoids the situation where, for a magnetic release configured in accordance with the invention, a malfunction of a residual current circuit breaker occurs. The anti-adhesion layer used can be a layer of corrosion resistant material, for example Ni or a nickel alloy.

An already pre-magnetized permanent magnet can also be incorporated. Thus, the configuration according to the invention achieves a situation where the working point of the permanent magnet remains approximately constant in any possible position of the plunger. Furthermore, there is an added advantage allowing the permanent magnet to be magnetized in the installed state, partial magnetization being carried out in the embodiment according to FIG. 2, and leading to the permanent magnet being magnetized further and further, since as a result its magnetic resistance becomes lower.

In order to manufacture the internal components of a release, use can be made of a pot-like mold 120 surrounding an internal space 121. See FIGS. 12 to 14. The bottom 122 of the mold 120 is located at one end, shown to the right of FIG. 12. The free end 123 is or can be closed by a cover 124, on whose side facing the internal space 121 is an integrally molded mandrel 125 projecting as far as the bottom 122 and ending at a short distance from the bottom 122. The mandrel 125 has two sections 126, 127 with different diameters. The diameter of the section 126 adjoining the cover 124 is greater than the other section 127. The diameter of the section 126 corresponds to the internal diameter of the annular permanent magnet 15. See FIG. 1 or 2. The transition from the section 126 to the section 127 is stepped and matched to the internal contour of the pole shoe 16 (see FIG. 1) so that the section 19 of the pole shoe 16 is matched to the external diameter of the section 127 of the mandrel 125. The step on the mandrel 125 corresponds to the step on the section 19 of the pole shoe 16. Disposed between the pole shoe 16 and the bottom 122 is an intermediate sleeve 128 that bears closely against the bottom 122 and against the pole shoe 16, ensuring that no gaps remain between the cover 124 and the permanent magnet 15 or between the permanent magnet 15 and the pole shoe 16, through which the compound of the coil former can penetrate inwards. On its outer face, the permanent magnet 15 has a circumferential groove 129. In the area of the bottom 122 and in the area of the cover 124, the inner wall of the internal space 121 widens. In the area of the bottom 122, the internal space 121 has a widening 130, and a return 131 in the area of the cover.

If, after the mold has been assembled, with the introduction of the intermediate sleeve 128 and the fitting of the cover 124 with the mandrel 125, the internal space 121 is potted with a suitable curing material, then the internal space 121 forms the coil former. Material of the coil former 132 engages in the circumferential groove 129 on the permanent magnet and, in this way, ensures that during the demolding operation the permanent magnet 15 does not fall out but is firmly held within the coil former 132. The pole shoe 16 is then held firmly between the permanent magnet 15 and the coil former.

FIG. 13 illustrates the coil former 132 with the flange webs 133 and,134, the permanent magnet 15, and the pole shoe 16. In the embodiment, the intermediate sleeve 128 has been removed so that, between the pole shoe and the end on the right of the coil former 132, at which the flange web 130 is located, the accommodation space 22*a* for the spring 23 remains. The coil former 132 is wound with the coil 135. Therefore, a unit is formed from the coil former, permanent magnet 15, pole shoe 16, and coil 135, and can be inserted into the pot-like yoke 11. See FIG. 14. The spring 23 is inserted into the space between the end of the coil former 132 having the flange 133, and, after that, the plunger 20 with the ridge 22 is inserted through the spring 23 and the pole shoe 16 and the permanent magnet 15. After the pot 11 has been closed by the cover 12, from which the plunger 20 projects, the release has been completed.

We claim:

1. An electromagnetic release, comprising:

a yoke;

a spring disposed in said yoke and having a spring force;

a plunger loaded by said spring in a release direction;

a permanent magnet configuration associated with said yoke and said plunger and having a magnet flux, an attraction force, and an active range;

a coil associated with said yoke and generating in said yoke a magnetic coil flux opposed to said magnet flux such that, when said magnetic coil flux is released, said spring force overcomes said attraction force of said permanent magnet configuration;

at least one pole shoe having an active range in magnetic communication with said yoke and said plunger, said at least one pole shoe and said permanent magnet configuration conducting said magnetic coil flux to said plunger such that:

in a first position of said plunger, said plunger is located in said active range of said permanent magnet configuration and in said active range of said at least one pole shoe, and both said magnetic coil flux and at least part of said magnet flux run through said plunger; and in a second position of said plunger, said plunger is located at least partly in said active range of said at least one pole shoe, and said magnet flux runs through said yoke, said plunger, and said permanent magnet configuration; and said at least one pole shoe and said permanent magnet being cast into a cylindrical body to form a coil former, with said coil, said coil former, said at least one pole shoe, and said permanent magnet forming a preassembled unit.

2. The release according to claim 1, wherein said yoke has two yoke sections running parallel to each other, and said plunger has a plunger axis running perpendicular to said two yoke sections, said plunger reaching through one of said two yoke sections and forming an air gap having a constant width throughout a movement of said plunger.

3. The release according to claim 2, wherein another of said two yoke sections has an inner face and said plunger bears against said inner face in said first position.

4. The release according to claim 3, wherein said plunger has an end face facing said other of said two yoke sections and said plunger is coated with an anti-adhesion layer on said end face.

5. The release according to claim 4, wherein said anti-adhesion layer is a material that is substantially corrosion resistant.

6. The release according to claim 5, wherein said material is selected from the group consisting of nickel and nickel alloy.

7. The release according to claim 2, wherein said coil is an annular coil;

said permanent magnet configuration is an annular permanent magnet;

said at least one pole shoe is an annular pole shoe;

said spring is a helical spring; and said yoke has a pot with a bottom and a cover for closing said pot, said cover defining an opening through which said plunger reaches, said cover forms said one of said two yoke sections, and said bottom of said pot forms said other of said two yoke sections;

said annular coil, said permanent magnet configuration, said annular pole shoe, said helical spring and said plunger insertable in said pot such that said plunger is surrounded by said annular permanent magnet, said annular pole shoe, and said helical spring, to form an electromagnetic drive.

8. The release according to claim 7, including a sleeve of insulating material, said bottom of said pot having an inner side, said at least one pole shoe and said permanent magnet being pressed against said inner side of said bottom of said pot with said sleeve of insulating material.

9. The release according to claim 1, wherein said plunger has a ridge, and said spring is disposed between said at least one pole shoe and said ridge.

10. The release according to claim 1, wherein said permanent magnet has at least one of the group consisting of a circumferential ridge and a groove holding said permanent magnet on said coil former in a form-fit.

11. A residual current circuit breaker electromagnetic release, comprising:

a yoke;

a spring disposed in said yoke and having a spring force;

a plunger loaded by said spring in a release direction;

a permanent magnet configuration associated with said yoke and said plunger and having a magnet flux, an attraction force, and an active range;

a coil associated with said yoke and generating in said yoke a magnetic coil flux opposed to said magnet flux such that, when said magnetic coil flux is released, said spring force overcomes said attraction force of said permanent magnet configuration;

at least one pole shoe having an active range in magnetic communication with said yoke and said plunger, said at least one pole shoe and said permanent magnet configuration conducting said magnetic coil flux to said plunger such that:

in a first position of said plunger, said plunger is located in said active range of said permanent magnet configuration and in said active range of said at least one pole shoe, and both said magnetic coil flux and at least part of said magnet flux run through said plunger; and in a second position of said plunger, said plunger is located at least partly in said active range of said at least one pole shoe, and said magnet flux runs through said yoke, said plunger, and said permanent magnet configuration; and said at least one pole shoe and said permanent magnet being cast into a cylindrical body to form a coil former, with said coil, said coil former, said at least one pole shoe, and said permanent magnet forming a preassembled unit.

* * * * *